US005970698A

United States Patent [19]

Tanaka et al.

[11] Patent Number: 5,970,698

[45] Date of Patent: Oct. 26, 1999

[54] ROTARY SPINNING RING STRUCTURE

[75] Inventors: Yutaka Tanaka, Gifu; Hiroshi Enomoto, Miwa-cho; Teruhiko Sato, Tsushima; Ryoji Asakawa, Shinkawa-cho; Yasushi Iwama, Kisogawa-cho; Koji Okada, Kanayanagi-cho; Susumu Yokoi, Ichinomiya, all of Japan

[73] Assignees: Howa Machinery, Ltd., Aichi-ken; Nippo Ltd., Osaka-fu, both of Japan

[21] Appl. No.: 08/969,603

[22] Filed: Nov. 13, 1997

[30] Foreign Application Priority Data

| | | | |
|---|---|---|---|
| Nov. 14, 1996 | [JP] | Japan | 8-320873 |
| Mar. 26, 1997 | [JP] | Japan | 9-093234 |
| May 15, 1997 | [JP] | Japan | 9-143233 |

[51] Int. Cl.[6] ..... D01H 7/64

[52] U.S. Cl. ..... 57/124; 57/122; 57/136; 57/75

[58] Field of Search ..... 57/75, 119, 120, 57/122, 123, 124, 125, 136, 137

[56] References Cited

U.S. PATENT DOCUMENTS

| | | | |
|---|---|---|---|
| 3,205,646 | 9/1965 | Morin | 57/119 |
| 3,343,362 | 9/1967 | Lunsford | 57/119 |
| 3,481,131 | 12/1969 | Chilpan | 57/124 |
| 4,302,927 | 12/1981 | Hope | 57/124 |
| 4,698,958 | 10/1987 | Nakano et al. | 57/119 |
| 5,009,063 | 4/1991 | Yamaguchi et al. | 57/124 |

FOREIGN PATENT DOCUMENTS

| | | | |
|---|---|---|---|
| 0 201 602 | 9/1985 | European Pat. Off. . | |
| 0 730 054 | 9/1996 | European Pat. Off. . | |
| 1201529 | 8/1989 | Japan | 57/124 |
| 2-26927 | 1/1990 | Japan . | |
| 3-51329 | 3/1991 | Japan . | |
| 4-163326 | 6/1992 | Japan . | |
| 8-158172 | 6/1996 | Japan . | |
| 8-209470 | 8/1996 | Japan . | |
| 52-51422 | of 1997 | Japan . | |

OTHER PUBLICATIONS

Patent Abstracts of Japan, vol. 007, No. 147 (C–173), Jun. 28, 1983 & JP 58 060027 A (Hirouki Kanai), Apr. 9, 1983.

Patent Abstracts of Japan, vol. 016, No. 461 (C–0988), Sep. 25, 1992 & JP 04 163323 A (Sumitomo Metal Ind. Ltd.), Jun. 8, 1992.

*Primary Examiner*—William Stryjewski
*Attorney, Agent, or Firm*—Ladas & Parry

[57] ABSTRACT

A rotary spinning ring structure for use on a spinning frame or the like comprises, as principal components, a stationary tube fixedly supported on a ring rail, a slide ring, a rotating tube assembly supported for rotation by the slide ring on the stationary tube, and a balancing mechanism incorporated into the rotating tube assembly. The rotating tube assembly comprises a rotating tubular body made of an antistatic synthetic resin material, a circular brake ring made of an antistatic synthetic resin material and joined to the rotating tubular body, and a dust cover made of an antistatic synthetic resin material and put on a middle portion of the rotating tubular body. Each of the antistatic synthetic resin materials forming the rotating tubular body, the brake ring and the dust cover is a mixture of a synthetic resin, and fibers, powder or flakes of a conductive material, such as carbon and has a low volume resistivity.

17 Claims, 10 Drawing Sheets

ROTARY SPINNING RING STRUCTURE

BACKGROUND OF THE INVENTION

1. Field of the Invention

The present invention relates to a rotary spinning ring structure provided with a rotating ring, to be used on a textile machine, particularly, a spinning machine which uses a traveler for winding a yarn on a bobbin, such as a ring spinning frame or a ring twisting frame.

2. Description of the Related Art

Various rotary spinning ring structures of the kind have been proposed to solve problems in fixed spinning rings. However, those previously proposed rotary spinning ring structures have not yet been put to practical use because of their complicated construction, high cost and possibility of deteriorating yarn quality due to unstable rotation of the ring. Recently, rotary spinning ring structures of simple construction that makes the practical use of the rotary spinning ring structures possible were proposed in, for example, JP-A Nos. 2-26927 (reference 1), 3-51329 (reference 2) and 8-209470 (reference 3). Each of a the rotary spinning frame structures proposed in the references 1 and 2 comprises, as principal components, a ring support member of a synthetic resin, and a rotating ring of a carbon steel or an alloy steel rotatably supported on the ring support member.

The rotary spinning ring structure proposed in the reference 3 is a negative rotary spinning ring structure comprising, as principal components, a stationary tube mounted on a ring rail coaxially with a spindle, a sliding ring fitted in the stationary tube, a steel rotating tube supported coaxially with the spindle on the sliding ring in the stationary tube, a traveler put on an upper portion of the rotating tube to guide a yarn so as to be able to revolve on the rotating tube, and a braking means including a braking ring and associated with a lower portion of the rotating tube. In this prior art negative rotary ring structure, the traveler is caused to slide for revolution along a flange formed on the rotating tube by a yarn being wound on a bobbin when the bobbin rotates together with the spindle. Consequently, the rotating tube is dragged frictionally for rotation by the traveler. The revolving speed of the traveler is always lower than the rotating speed of the bobbin, so that the yarn is wound on the bobbin at a rate corresponding to the difference between the rotating speed of the bobbin and the revolving speed of the traveler. The rotating tube rotates at a rotational speed lower than the revolving speed of the traveler due to its inertia in an initial stage of a spinning operation in which the bobbin is accelerated and the rotational speed of the bobbin increases continuously, and hence the traveler slides along the flange of the rotating tube for revolution in a mode in which a traveler slides along the flange of a fixed spinning ring. After the rotational speed of the bobbin has reached a predetermined operating rotational speed, the rotary tube rotates at a rotational speed substantially equal to the revolving speed of the traveler and hence the traveler does not move relative to the rotary tube. During the deceleration of the bobbin to stop the spinning operation, it is possible that the rotating tube and the traveler decelerate more slowly than the bobbin due to the inertia of the rotating tube. Therefore, the rotating tube is braked by the braking means so that the rotating tube and the traveler may decelerate according to the deceleration of the bobbin.

The inventors studied the prior art rotary spinning ring structure proposed in the reference 3 and conducted spinning experiments using the same rotary spinning ring structure to put the rotary spinning ring structure to practical use. It was found through the spinning experiments that, although the rotating tube rotates smoothly with the revolution of the traveler and the yarn can be wound on the bobbin, a yarn of some type is liable to be broken when the spindle starts rotating after the broken yarn has been pieced and such a yarn requires skilled yarn piecing technique, that a balloon produced by the yarn is liable to collapse when the traveler and the rotating tube start deceleration while the traveler and the rotating tube repeat acceleration and deceleration alternately according to the vertical movement of the ring rail for a cop building operation, and that the yarn stiffens and the elongation of the yarn reduces to deteriorate the quality of the yarn when the yarn is wound on the bobbin by using the rotary spinning ring structure. Such a tendency is particularly conspicuous when the spindle is rotated at a high rotational speed not lower than 15,000 rpm, such as 20,000 rpm.

It was found through the examination of those problems found through the spinning experiments that the principal cause of those problems is the excessively large weight of the rotating tube and the resultant incapability of the rotating tube to rotate properly according to the revolution of the traveler. Steel rotating tubes (rotating rings) of 45 to 70 mm in inside diameter of the rotary spinning ring structure disclosed in the references 1 and 2 have a considerably large weight in the range of 43 to 200 g. The reduction of the weight of the rotating tube is one of measures to improve the capability of the rotating tube to rotate according to the revolution of the traveler. A lightweight rotating tube may be formed by molding a synthetic resin. The same idea as that is found in JP-U No. 52-51422. This idea proposes a combination of a relatively large traveler and a carbon-fiber-reinforced plastic conical ring.

The inventors found through spinning experiments using a rotary spinning ring structure provided with a synthetic resin rotating tube that the reduction in weight of the rotating tube is effective in improving the rotation of the rotating tube according to the revolution of the traveler, and that the deterioration of the yarn quality can be avoided when the weight of the rotating tube is less than a certain weight. Thus, no practical problem occurred if the rotating speed of the spindle was below 15,000 rpm. However, when the rotary spinning ring structure is used on an advanced spinning frame which operates at a high spindle speed not lower than 15,000 rpm, the rotating tube may possibly be melted by heat generated in the traveler or a bearing member if the rotation of the rotating tube is obstructed by some cause or if something is wrong with the bearing member. If heated excessively, the rotating tube gives out smoke or emits an evil smell and, if things come to the worst, the rotating tube burns, which is a problem in safety. The cost reduction of the rotary spinning ring structure also is a very important problem in view of realizing the practical use of the same.

Generally, synthetic resins are electrical insulators and are easy to be charged with static electricity. Static electricity accumulated on a portion of the rotating tube along which the traveler slides exerts particularly harmful influence. It was found that static electricity accumulated on the rotating tube attracts flies and dust to the rotating tube, flies and such fall off the rotating tube and are twisted into the yarn, the discharges of static electricity accumulated on the rotating tube at a high voltage give the operator an electric shock, and sparks and arcs generated by the discharges of static electricity cause waste fibers to burn, which may possibly cause fire.

If the weight of the rotating tube is not distributed uniformly and the rotating tube has a mass eccentricity with respect to its geometrical center axis, the rotating tube whirls and generates vibrations even if the mass of the rotating tube is small. Consequently, the resistance exerted by the bearing on the rotating tube assembly varies in a wide range, the magnitude of the resistance increases to deteriorate the rotating performance of the rotating tube and the revolving performance of the traveler, so that the tension of the yarn varies to deteriorate yarn quality or to cause yarn breakage. Vibrations generated by the rotating tube and the high frictional resistance exerted by the bearing to the rotating tube damages the bearing and shortens the life of the rotating tube.

SUMMARY OF THE INVENTION

Accordingly, it is a first object of the present invention to provide a rotary spinning ring structure having a rotating tube assembly capable of smoothly rotating according to the revolution of a traveler thereon, and capable of preventing the breakage of a yarn immediately after the broken yarn has been pieced, of preventing a balloon produced by the yarn from being collapsed by a cop building operation, and of spinning and winding a yarn having satisfactory elongation.

A second object of the present invention is to provide an inexpensive, practical rotary spinning ring structure of simple construction having a light weight rotating tube assembly having a rotating tube body formed of a light alloy having a specific gravity of five or below, such as an aluminum alloy, or a synthetic resin, and capable of safely and stably functioning on an advanced spinning frame which operates at a very high spindle speed.

A third object of the present invention is to provide a practical, highly safe rotary spinning ring structure having a light weight rotating tube assembly having a rotating tube body formed of a synthetic resin and capable of smoothly rotating according to the revolution of a traveler thereon, and capable of preventing the breakage of a yarn immediately after the broken yarn has been pieced, of preventing a balloon produced by the yarn from being collapsed by a cop building operation, of spinning and winding a yarn having satisfactory elongation and of preventing the accumulation of static electricity on the rotating tube assembly and the resultant harmful influences.

A fourth object of the present invention is to provide a rotating spinning ring structure having a dynamically well-balanced rotating tube assembly not subject to the dynamically unbalancing effect of a traveler, capable of smooth rotation, of stabilizing yarn tension to secure good yarn quality and of preventing yarn breakage, permitting a spinning frame to operate at a high spindle speed for spinning at a high productivity, and having capacity to be used in combination with travelers of weights in an expanded range of weight and to be used for spinning yarns of yarn counts in a wide range of yarn count.

According to the present invention, a rotary spinning ring structure comprises a stationary tube supported on a ring rail coaxially with a spindle, and a rotating tube assembly disposed coaxially with and supported for rotation on the stationary tube, and having an upper end portion capable of guiding a traveler for revolution thereon to guide a yarn. In this rotary spinning ring structure, a rotating tube body of the rotating tube assembly is formed of a light alloy or a synthetic resin having a specific gravity of five or below, and the upper end portion is formed of a metal or a ceramic material having a hardness higher than the material forming the main portion of the rotating tube assembly and superior in abrasion resistance to the material forming the main portion of the rotating tube assembly.

According to the present invention, a bearing member may be disposed in the stationary tube, and the rotating tube assembly may be disposed coaxially with and supported for rotation on the bearing member in the stationary tube. Portions of the rotating tube assembly to be brought into sliding contact with the traveler and the bearing member, respectively, are formed of a metal or a ceramic material having a hardness higher than the material forming the main portion of the rotating tube assembly and superior in abrasion resistance to the material forming the main portion of the rotating tube assembly.

According to the present invention, a traveler guide ring made of a metal or a ceramic material having a hardness higher than that of the material forming the major portion of the rotating tube assembly and superior in abrasion resistance to the material forming the major portion of the rotating tube assembly may be fixedly fitted on the upper end portion of the rotating tube assembly so that the traveler slides along the traveler guide ring.

According to the present invention, the portion of the rotating tube assembly to be brought into sliding contact with the traveler and the portion of the same to be brought into sliding contact with the bearing member may be coated with a film of a ceramic material or a metal.

According to the present invention, the rotating tube assembly may be formed by combining the portion of the rotating tube assembly to be brought into sliding contact with the traveler and the portion of the same to be brought into sliding contact with the bearing member with the main portion of the same by insert molding.

According to another aspect of the present invention, a rotary spinning ring structure comprises a stationary tube supported on a ring rail coaxially with a spindle, and a rotating tube assembly disposed coaxially with and supported for rotation on the stationary tube, and including a rotating tubular body having a traveler guide portion in its upper end portion capable of guiding a traveler for revolution thereon to guide a yarn. In this rotary spinning ring structure, at least a body portion of the rotating tube assembly between a traveler guide portion of the same to be brought into sliding contact with the traveler and a bearing portion of the same to be brought into sliding contact with the stationary tube is formed of an antistatic synthetic resin material, and static electricity generated in the traveler guide portion is discharged through the bearing portion to the ring rail.

According to still another aspect of the present invention, a rotary spinning ring structure comprises a stationary tube supported on a ring rail coaxially with a spindle, a bearing member having a slide ring and disposed in the stationary tube, and a rotating tube assembly disposed coaxially with and supported for rotation on the slide ring of the bearing member in the stationary tube, and having an upper end portion capable of guiding a traveler for revolution thereon to guide a yarn. In this rotary spinning ring structure, the stationary ring and the slide ring are formed of an antistatic synthetic resin material, at least a tubular body portion of the rotating tube assembly between a traveler guide portion of the same to be brought into sliding contact with the traveler and a bearing portion of the same is formed of an antistatic synthetic resin material, and static electricity generated in the traveler guide portion is discharged through the bearing portion and the slide ring and the stationary tube to the ring rail.

According to the present invention, at least the tubular portion between the traveler guide portion and the bearing portion of the rotating tube assembly may be formed of a synthetic resin, and the surface of the tubular portion may be coated with an antistatic synthetic resin gmaterial to discharge static electricity generated in the traveler guide portion through the bearing portion to the ring rail.

According to the present invention, the antistatic synthetic resin material is prepared by mixing a synthetic resin, and fibers, power or flakes of a conductive material and has a volume resistivity of $10^{12}$ Ω·cm or below.

According to the present invention, the rotating tube assembly is provided with a balancing mechanism including a balancing member which moves so as to counterbalance the dynamic unbalance.

According to the present invention, the rotating tube assembly may be provided with an annular groove having its center on the axis thereof, and a balance weight may be placed in the annular groove for movement along the annular groove.

According to the present invention, the annular groove may be a sealed space, and the balance weight may be a fluid.

The above and other objects, features and advantages of the present invention will become more apparent from the following description taken in connection with the accompanying drawings.

DESCRIPTION OF THE PREFERRED EMBODIMENTS

First Embodiment

Figure 1:
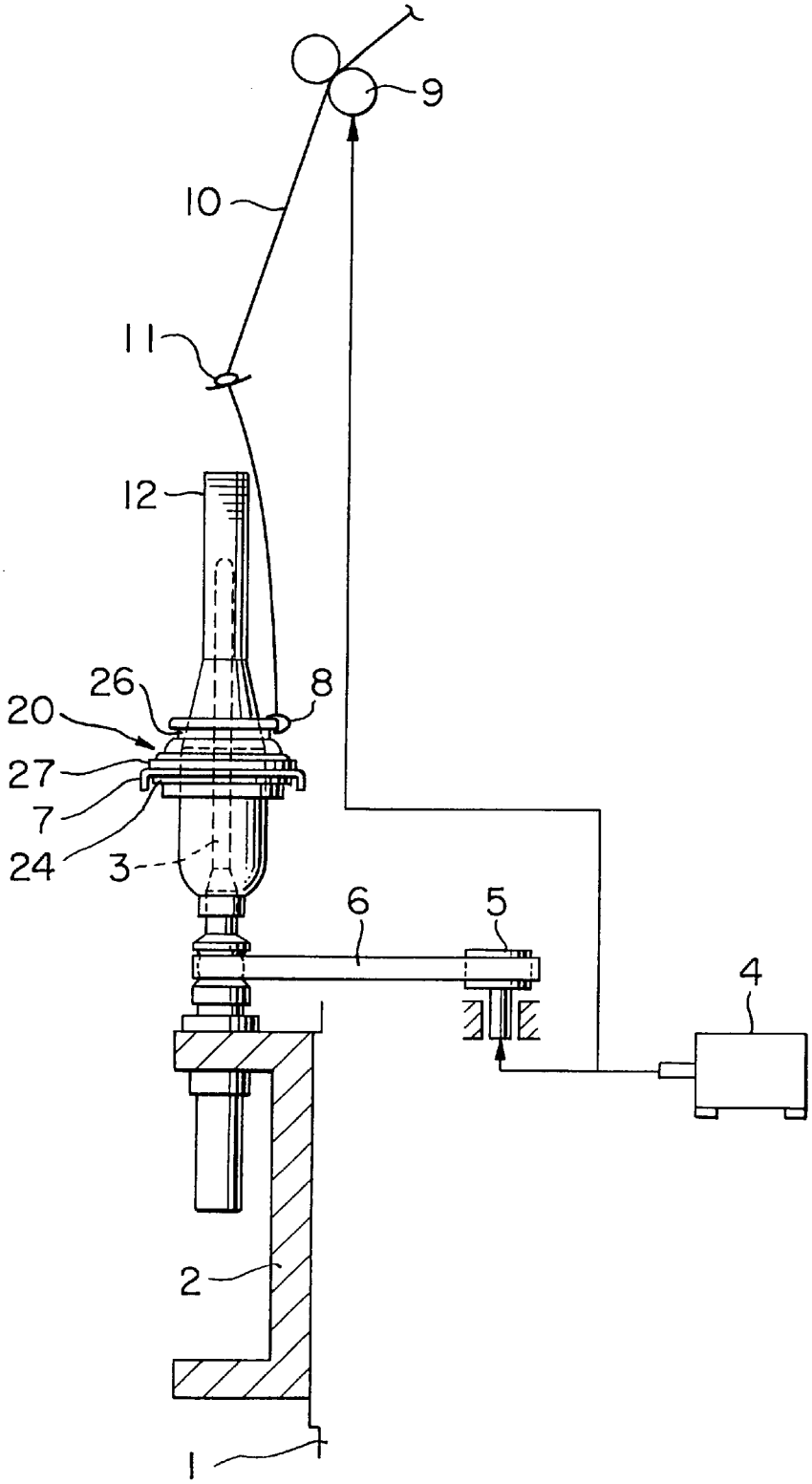
FIG. 1 is a side view of a spinning unit of a spinning frame.

Referring to FIG. 1, a plurality of spindles 3 are arranged longitudinally at fixed pitches and supported for rotation on a spindle rail 2 of a spinning frame 1. Each spindle 3 is driven for rotation by a main motor 4 through a drive shaft, a pulley 5 and a belt 6. Each spindle 3 may be driven by an individual motor provided for each spinning unit. A ring rail 7 is reciprocated vertically for a predetermined stroke for a cop building operation by a lifting mechanism, not shown, and the range of vertical reciprocation of the ring rail 7 is increased gradually by a shaping mechanism. Rotary spinning ring structures 20 are mounted on the ring rail 7 in alignment with their respective spindles. Each rotary spinning ring structure 20 supports a traveler 8 for revolution about the spindle 3. The traveler 8 revolves about the spindle 3 to guide a yarn 10 delivered by a drafting roller 9 and traveling through a snail wire 11 toward the rotary spinning ring structure 20. A number of loops of the yarn 10 corresponding to the difference between the rotating speed of the spindle 3 and the revolving speed of the traveler 8 are wound on a bobbin 12 every unit time.

The rotary spinning ring structure 20 according to a first embodiment of the present invention will be described with reference to FIGS. 2 to 4. The ring rail 7 is provided with holes 21 with their center axes aligned with the axis C of rotation of the spindles 3, respectively, and a stationary tube 22 is fitted in each hole 21 with its circular flange 22*a* seated on an upper surface of the ring rail 7. The stationary tube 22 is held fixedly in place on the ring rail 7 with a rubber set ring 24 fitted in a circular groove 23 formed in the outer circumference of a lower cylindrical portion 22*b* of the stationary tube 22 projecting downward from the ring rail 7. The stationary tube 22 is formed of a conductive synthetic resin material and absorbs rotational vibrations generated by a rotating tube assembly 26 when the same rotates to prevent the peeling of a paint coat applied to the surface of the ring rail 7 by the rotational vibrations and the resultant rusting of the ring rail 7. The stationary tube 22 is formed of the conductive synthetic resin material to prevent the accumulation of static electricity generated during a spinning operation on the rotary spinning ring structure 20. The synthetic resin material is prepared by kneading a mixture of polyphenylene sulfide resin (PPS) and 30% by weight carbon fibers (CF), and has a volume resistivity R of $1\times10^{3}$ Ω·cm or below.

A reinforcing ring 25A of a synthetic resin is fitted in the stationary tube 22, and a slide ring (slide bearing) 25, i.e., a bearing member, is rotatably fitted in the reinforcing ring 25A. The rotating tube assembly 26 is inserted in the stationary tube 22 and is supported rotatably by the slide ring 25 with its center axis aligned with the axis C of rotation of the spindle 3. The reinforcing ring 25A restrains the slide ring 25 provided with a split from expansion when the slide ring 25 is put on a reinforcing bearing 32 to prevent the deformation of the slide ring 25. If the slide ring 25 is directly put on the rotating tube assembly 26 and the external shape of the same is not subject to change, the reinforcing ring 25A may be omitted. A synthetic resin cover 27 is fitted on an upper portion of the stationary tube 22 to restrain the slide ring 25 and the reinforcing ring 25A from moving off the stationary tube 22.

The slide ring 25 is a bearing member for supporting the rotating tube assembly 26. The slide ring 25 is formed of a highly abrasion-resistant synthetic resin having low frictional property, such as polytetrafluoroethylene (PTFE) or an elastomer, or a metal. The reinforcing ring 25A is formed of a material having a rigidity higher than that of the material forming the slide ring 25; that is, the reinforcing ring 25A is formed of a synthetic resin, such as polyacetal (POM: polyoxymethylene) or a metal. If the slide ring 25 is formed of a synthetic resin material, the synthetic resin material is prepared by kneading a mixture of polytetrafluoroethylene (PTFE) and 10% by weight carbon fibers (CF) and has a volume resistivity R of $1\times10^{10}$ Ω·cm or below. Static electricity can be discharged through the slide ring 25. The reinforcing ring 25A need not necessarily be formed of an antistatic synthetic resin material. The reinforcing ring 25A may be formed of an antistatic synthetic resin material prepared by kneading a mixture of polyacetal (POM) and 5% by weight carbon powder and having a volume resistivity R of $1\times10^{8}$ Ω·cm or below. Preferably, the synthetic resin cover 27 is formed of an antistatic synthetic resin material, such as an antistatic material prepared by kneading a mixture of polyacetal (POM) and 5% by weight carbon powder and having a volume resistivity R of $1\times10^{8}$ Ω·cm or below. It is important, in view of suppressing vibration, to form the slide ring 25 and the reinforcing ring 25A of materials respectively having different vibrational characteristics, respectively.

The rotating tube assembly 26 comprises a tubular rotating tubular body 28 made of an antistatic synthetic resin material having a specific gravity of five or below, such as an engineering plastic, a circular brake ring 29 made of an antistatic synthetic resin, and a dust cover 30 made of an antistatic synthetic resin and put on a middle portion of the rotating tubular body 28. The antistatic synthetic resin material forming the rotating tubular body 28 is prepared by kneading, for example, a mixture of polyphenylene sulfide (PPS) and 30% by weight carbon fibers (CF) and has a volume resistivity R of $1\times10^{3}$ Ω·cm or below. The antistatic synthetic resin material forming the brake ring 29 and the dust cover 30 is prepared by kneading, for example, polyacetal (POM) and 5% by weight carbon powder and has a volume resistivity R of $1\times10^{3}$ Ω·cm or below.

Figure 2:
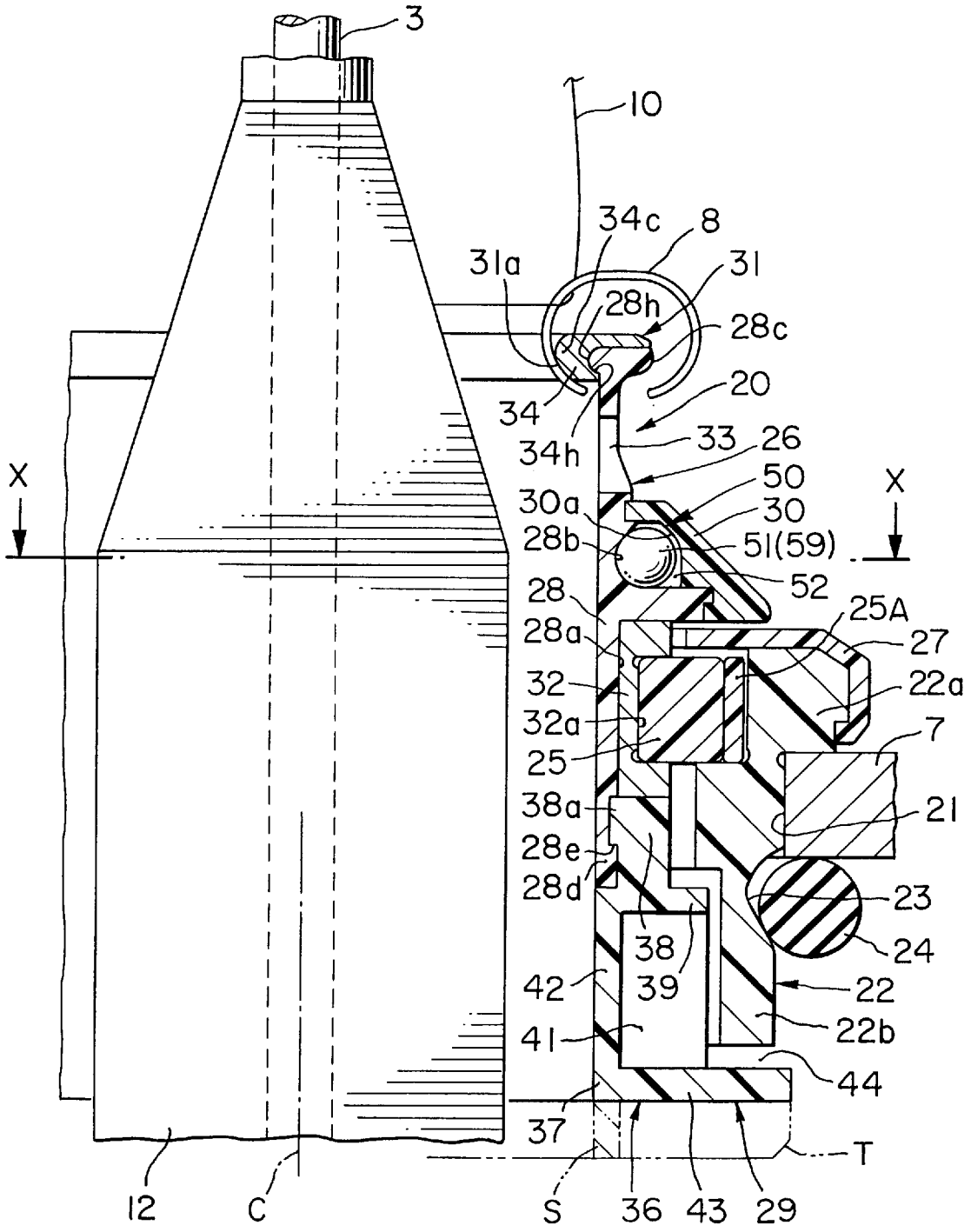
FIG. 2 is a half vertical section of a rotary spinning ring structure according to a first embodiment according of the present invention.

Although the rotating tube assembly 26 shown in FIG. 2 is formed entirely of synthetic resins, all the components of the rotating tube assembly 26 need not be formed of synthetic resins; the components may be formed of any kinds of materials as long as at least a middle portion of the rotating tube assembly 26 between a traveler guide portion along which a traveler slides and a sliding portion to be in sliding contact with the slide ring 25 is formed of an antistatic synthetic resin to discharge static electricity generated in the traveler guide portion through the slide ring 25, i.e., a bearing member to the ring rail 7. The antistatic synthetic resin material may contain a conductive material other than carbon fibers, such as fibers, powder or flakes of a metal or a conductive organic material.

The rotating tubular body 28 is provided in its outer circumference with a recessed cylindrical surface 28*a*. The annular reinforcing bearing 32 made of a steel having a hardness higher than that of the material forming the rotating tubular body 28 and excellent abrasion resistance, is fitted fixedly on the cylindrical surface 28*a*. The reinforcing bearing 32 is formed by machining. The slide ring 25 is fitted for sliding rotation relative to the reinforcing bearing 32 on a bearing portion 32*a* of the reinforcing bearing 32 by a running fit.

An outer flange 28*c* and an inner flange 28*h* are formed at the upper end of the rotating tubular body 28, i.e., a main part of the rotating tube assembly 26. A plurality of fly outlet openings 33 are formed in a portion of the rotating tubular body 28 below the outer flange 28*c* at equal angular intervals. Air containing flies flows outside through the fly outlet openings 33. A traveler guide ring 34 is fitted on the inner flange 28*h* of the rotating tubular body 28. The traveler ring 34 is made of a steel or a ceramic material having a excellent abrasion resistance and a hardness higher than that of the material forming the rotating tubular body 28, and provided with a circular groove in its outer circumference. The traveler guide ring 34 is held firmly in place on the inner flange 28*h* by the resilience of the inner flange 28*h* of a synthetic resin. The traveler guide ring 34 has an inner bulge 34*c*. The inner bulge 34*c* of the traveler guide ring 34 and the outer flange 28*c* of the rotating tubular body 28 form a guide flange 31 for guiding the traveler 8. The inner bulge 34*c* of the traveler guide ring 34 has a traveler guide surface 31*a* for guiding the traveler 8 for revolution on the guide flange 31. The dust cover 30 is fixedly put on a portion of the rotating tubular body 28 below the guide flange 31 and slightly above the cover 27. The respective materials of the reinforcing ring 32 and the traveler guide ring 34 are metals having a high abrasion resistance and a hardness higher than that of the material of the rotating tubular body 28. The respective materials of the reinforcing ring 32 and the traveler guide ring 34 may be ceramic materials having a high abrasion resistance and a hardness higher than that of the material of the rotating tubular body 28.

Figure 3:
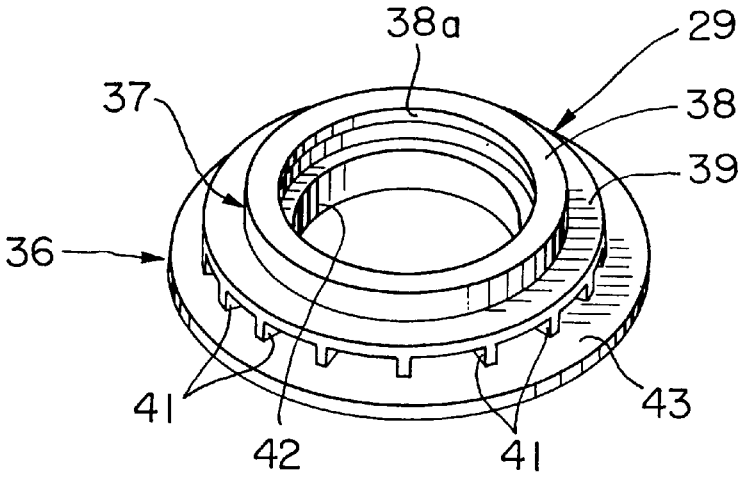
FIG. 3 is a perspective view of a brake ring.
Figure 4:
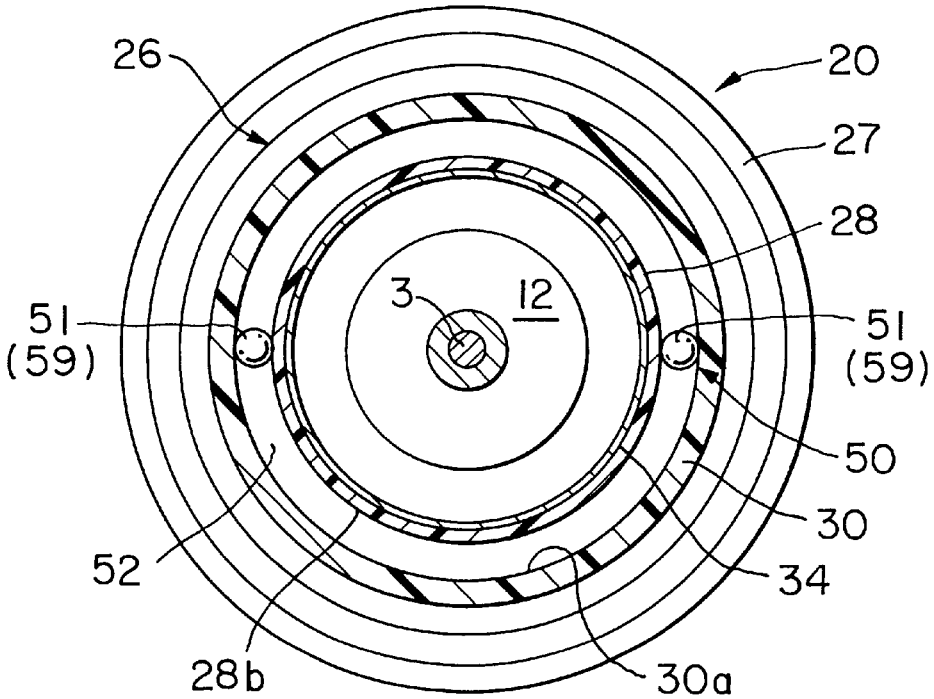
FIG. 4 is a sectional view taken on line IX—IX in FIG. 2 for assistance in explaining a balancing mechanism.

As shown in FIG. 3, the brake ring 29 has a brake ring 36 of a synthetic resin fixedly put on the rotating tubular body 28. The brake ring 36 has an annular portion 37 and a tubular portion 38 projecting from the upper end of the annular portion 37. An upper flange 39 is formed at the lower end of the tubular portion 38. The tubular portion 38 of the brake ring 36 is fitted on a lower portion 28*d* of the rotating tubular body 28 from below. A circular projection 38*a* formed on the inner circumference of the tubular portion 38 and a circular groove 28*e* formed in the outer circumference of the rotating tubular body 28 are engaged to hold the brake ring 36 fixedly in place on the rotating tubular body 28. The upper end of the tubular portion 38 is pressed against the reinforcing bearing 32 to hold the reinforcing bearing 32 fixedly in place. A lower flange 43 is formed at the lower end of the annular portion 37. A plurality of vertical radial fins 41 are arranged at equal angular intervals between the upper flange 39 and the lower flange 43 so as to extend in vertical planes including the center axis C of rotation of the spindle 3. The radial fins 41 function effectively regardless of the direction of rotation of the rotating tubular body 28, i.e., both when the spinning frame operates for spinning S-twist yarns and when the spinning frame operates for spinning Z-twist yarns.

The inner ends of the radial fins 41 are joined to the annular portion 37 serving as a shielding wall 42 for screening the radial fins 41 from a space around the bobbin 12. The lower ends of the radial fins 41 are joined to the lower flange 43. The lower flange 43 extends from the lower end of the shielding wall 42 so that the peripheral portion thereof lies under the lower end of the stationary tube 22 with a narrow space 44 between the peripheral portion and the lower end of the stationary tube 22.

The rotating tubular body 28, the traveler 8 and the brake ring 29 are designed so that the frictional resistance exerted by the rotating tubular body 28 on the traveler 8 and the resistance of air against the rotation of the brake ring 29 while the bobbin 12 on the spindle 3 is in steady rotation at a high rotating speed, allow the rotation of the rotating tube assembly 26 substantially together with the revolving traveler 8.

The rotating tubular body 28, the dust cover 30 and the brake ring 36 are made of a synthetic resin material having a specific gravity of five or below in lightweight structures, respectively. The rotating tubular body 28, the dust cover 30 and the brake ring 36 may be made of a light alloy having a specific gravity of five or below, preferably three or below, such as an aluminum alloy. If it is desired to enhance the braking effect of the brake ring 29, an extension wall S may be extended downward from the lower end of shielding wall 42, and vertical radial fins T similar to the radial fins 41 may be formed on the lower surface of the lower flange 43 as indicated by alternate long and two short dashes lines in FIG. 2. The vertical length of the fins T is dependent on a braking force required by a yarn quality. A plurality of kinds of brake rings respectively provided with fins T of different vertical lengths may be kept in stock and an appropriate one of the plurality of kinds of brake ring may be selectively employed.

A balancing mechanism 50 for keeping the rotating tubular body 28 in a dynamically balanced state is incorporated into the rotating tubular body 28. The balancing mechanism 50 comprises a middle portion of the rotating tubular body 28 provided in its outer circumference with a circular groove 28*b*, the dust cover 30 having an inner surface 30*a* forming an annular guide passage 52 together with the circular groove 28*b* of the rotating tubular body 28, and one or a plurality of balance weights 51 placed in the guide passage 52 so as to be movable along the guide passage 52. The guide passage 52 is an annular space having its center on the axis C of rotation of the spindle 3. The balancing mechanism 50 may be provided with a circular guide rail formed on the outer circumference of the rotating tubular body 28 or on the inner surface of the dust cover 30 instead of the guide passage 52, and the balance weight or the balance weights may be put on the guide rail so as to revolve along the guide rail.

The balance weight 51 in this embodiment is a spherical balance ball 59 capable of rolling along the guide passage 52. The balance ball 59 may be made of a metal, a resin, a ceramic material or the like. The weight of the balance ball 59 must be accurately determined through complicated calculation so as to establish a balanced state if the balancing mechanism 50 is provided with only one balance ball 59, whereas such complicated calculation is unnecessary if the balancing mechanism 50 is provided with a plurality of balance balls 59. Therefore, it is preferable that the balancing mechanism 50 is provided with a plurality of balance balls 59. If the balancing mechanism 50 is provided with a plurality of balance balls 59, the balance balls 59 may be different from each other in size, material and weight. In this embodiment, the balancing mechanism 50 is provided with two balance balls 59 as shown in FIG. 4. If necessary, the surface defining the guide passage 52 may be coated with a small amount of igrease to prevent the excessively sensitive response of the balance balls 59. If the surface defining the guide passage 52 is coated with grease, the guide passage 52 is sealed.

The operation of the rotary spinning ring structure 20 thus constructed will be described below. The main motor 4 of the spinning frame 1 is started. Then, the spindle 3 is driven for rotation, the ring rail 7 is reciprocated vertically for a cop building operation, the yarn 10 delivered from the draft roller 9 and traveling through the snail wire 11 and the traveler 8 toward the bobbin 12 is twisted and wound on the bobbin 12 to build a cop. As the bobbin 12 rotates together with the spindle 3, the traveler 8 is dragged by the yarn 10 to revolve along the guide flange 31. Then, the traveler 8 drags the rotating tube assembly 26 frictionally for rotation. Since the rotating tubular body 28, i.e., a main component of the rotating tube assembly 26, and the brake ring 36 are made of synthetic resins and the rotating tube assembly 26 is a lightweight structure, the rotating tube assembly 26 can be easily dragged for rotation by the revolving traveler 8. Accordingly, a reduced tension is induced in the yarn 10 during the acceleration of the bobbin 12 and during the steady rotation at a high rotational speed of the spindle 3. Consequently, the possibility of yarn breakage is reduced, a yarn piecing operation is facilitated, the yarn 10 can be wound on the bobbin 12 without reducing its elongation, and the power consumption rate of the spinning frame 1 is reduced greatly.

During the steady rotation of the spindle 3 at a high rotational speed, the traveler 8 is pressed firmly against the guide flange 31 of the rotating tube assembly 26 by centrifugal force acting thereon, and hence the rotating tube assembly 26 rotates substantially exactly with the revolving traveler 8. Therefore, the abrasion of the traveler 8 is reduced even if the traveler 8 is used on a spinning frame 1 operating at a high spindle speed and the life of the traveler 8 is extended. If the spinning frame 1 provided with the rotary spinning ring structures 20 is used for spinning cotton yarns or synthetic yarns, yarns of satisfactory yarn quality can be spun when the weight of the rotating tube assembly 26 having the rotating tubular body 28 having the flange 31 of 41 mm in inside diameter is 30 g or below. The yarn quality is very satisfactory particularly when the weight of the same arotating tube assembly 26 is 20 g or below.

During the steady rotation of the spindle 3 at a high rotational speed, the rotating tube assembly 26 rotates substantially exactly with the revolving traveler 8. If the rotation of the lightweight rotating tube assembly 26 is decelerated or stopped by some obstacle, such as flies, the traveler 8 slides at a high speed along the traveler guide surface 31*a* of the flange 31 and frictional heat is generated in the traveler 8 and the flange 31. The frictional heat is generated at a considerably high rate when the spindle speed is 15,000 rpm or above. However, since the traveler guide ring 34 having the traveler guide surface 31*a* is made of a metal, the traveler guide surface 31*a* will not be easily abraded and will not be melted. Thus, the rotating tube assembly 26, similarly to a rotating tube assembly comprising steel components, functions with reliability and is safe from troubles. The slide ring 25 rotates slowly relative to the reinforcing bearing 32 as the rotating tube assembly 26 rotates at a high rotating speed. However, the synthetic resin slide ring 25 will not melt because the reinforcing bearing 32 is made of a metal.

The rotating tube assembly 26 rotates substantially exactly with the revolving traveler 8 during the steady rotation of the spindle 3 at a high rotational speed. The rotating tube assembly 26 has a mass eccentricity with respect to the axis C of rotation attributable to errors in machining the components thereof and to the eccentric loading by the traveler 8. Consequently, the rotary spinning ring structure 20 is caused to whirl by the dynamic unbalance of the rotating tube unit 26 and thereby vibrations are generated. However, since the principal components or portions of the rotating tube assembly 26 are formed of synthetic resins and the rotating tube assembly 26 has a relatively small weight, the energy of the vibrations is not high. Since the balancing mechanism 50 is incorporated into the rotating tube unit 26, the mass eccentricity of the rotating tube assembly 26 is canceled out by the balance balls 59 which moves in the guide passage 52, so that the rotating tube assembly 26 is dynamically balanced for smooth rotation.

It is generally known that, when a rotating body included in a vibration system and provided with a spherical weight capable of moving along a circular passage concentric with the rotating body is caused to whirl by a mass eccentricity therein, the mass eccentricity is on the outer side of the rotating body with respect to the axis of the whirling of the rotating body while the rotational speed of the rotating body is lower than the speed corresponding to the resonance point of the vibration system, and is on the inner side of the rotating body with respect to the axis of the whirling of the rotating body while the rotating speed of the rotating body is higher than the speed corresponding to the resonance point of the vibration system, the spherical weight is always on the outer side of the rotating body with respect to the axis of the whirling of the rotating body, and hence the mass eccentricity of the rotating body is counterbalanced by a centrifugal force acting on the spherical weight while the rotational speed of the rotating body is higher than the resonance point. The rotating tube assembly 26 of the rotary spinning ring structure 20 is driven for rotation at a high rotating speed of 15,000 rpm or above. Therefore, it is considered that the rotating tube assembly 26 rotates always at a rotational speed exceeding the resonance point. When the rotating tube assembly 26 rotates at a high rotational speed, the two balance balls 59 move immediately along the guide passage 52 to a side opposite the side of the mass eccentricity, i.e., the side of the traveler 8, so that the centrifugal force acting on the mass eccentricity is counterbalanced by the centrifugal force acting on the two balance balls 59 to suppress the whirling of the rotating tube assembly 26. Consequently, vibrations are reduced and the rotating tube assembly 26 continues smooth rotation.

When winding the yarn 10 on the bobbin 12, the traveler 8 slides along the traveler guide ring 34, and the yarn 10 rubs the traveler 8, whereby static electricity is accumulated on the traveler 8 and the traveler guide ring 34. The static electricity thus accumulated is discharged through the steel traveler guide ring 34, the rotating tubular body 28 of an antistatic synthetic resin material, the steel reinforcing bearing 32, the slide ring 25 of an antistatic synthetic resin material and the stationary tube 22 of an antistatic synthetic resin material to the ring rail 7. Consequently, the accumulation of static electricity on the rotating tube assembly 26 can be prevented. Accordingly, this structure eliminates the harmful effects of static electricity, such as attraction of flies and dust to and accumulation of the same on the rotating tube assembly 26, twisting flies and such fell off the rotating tube assembly 26 into the yarn, the discharges of static electricity accumulated on the rotating tube at a high voltage giving the operator an electric shock, and generation of sparks and arcs causing waste fibers to burn.

Once the rotating tube assembly 26 starts rotating, the inertia of the rotating tube assembly 26 tries to maintain the rotation of the rotating tube assembly 26. However, since the weight of the rotating tube assembly 26 is small, the kinetic energy of the rotating tube assembly 26 rotating by inertia is small. The rotating tube assembly 26 is braked moderately by the resistance of air against the rotation of the fins 41 of the brake ring 36. Since the brake ring 26 has the shielding wall 42, whirling air currents generated by the rotating bobbin 12 are unable to act on the fins 41 and hence the deceleration of the rotating tube assembly 26 is not impeded by the whirling air currents. Therefore, when the ring rail 7 starts moving up after reaching the lower end of its stroke for the cop building operation and the rotating tube assembly 26 starts deceleration, the rotating tube assembly 26 and the traveler 8 are decelerated properly by the braking effect of the brake ring 36. Therefore, the collapse of the balloon of the yarn 10 due to the temporarily delayed deceleration of the rotating tube assembly 26 and the traveler 8 at the change of the moving direction of the ring rail 7 for the cop building operation can be prevented, interference between the balloon of the yarn 10 and separators, not shown, disposed between the adjacent spindles 3 can be avoided, so that yarn breakage can be prevented and yarns of a satisfactory quality can be spun. Since the rotating tube assembly 26 is very light, only a low force is necessary for rotating the rotating tube assembly 26 together with the traveler 8 and hence the spinning frame 1 operates at a low power consumption rate.

The braking effect of the brake ring 36 prevents the rotation of the rotating tube assembly 26 at a rotational speed exceeding the revolving speed of the traveler 8 during the deceleration of the rotating tube assembly 26, and the yarn 10 will not snarl around the traveler 8 when the spindle 3 stops because the rotating tube assembly 26 and the traveler 8 stop synchronously when the spindle 3 stops.

Since the upper, the lower and the inner ends of the fins 41 are joined to the upper flange 39, the lower flange 43 and the shielding wall 42, respectively, and the fins 41 turn in a space enclosed by the upper flange 39, the shielding wall 42, the lower flange 43 and the lower portion of the stationary tube 22, the movement of the fins 41 through air is suppressed and excessive braking force is not produced. Consequently, energy required by the spindle 3 for driving the bobbin 12, the traveler 8 and the rotating tube assembly 26 is saved and the spinning frame 1 is able to operate at a low running cost.

Since the space adjacent to the slide ring 25 communicates with the external space by means of a space between the brake ring 36 and the lower portion of the stationary tube 22 and the radial space 44 between the lower end of the stationary tube 22 and the lower flange 43 of the brake ring 36, the rotation of the brake ring 36 generates radial air currents through the space 44, so that air currents are produced around the slide ring 25 and heat generated in the slide ring 25 can be efficiently dissipated to assure the long-term smooth rotation of the rotating tube assembly 26.

Second Embodiment

Figure 5:
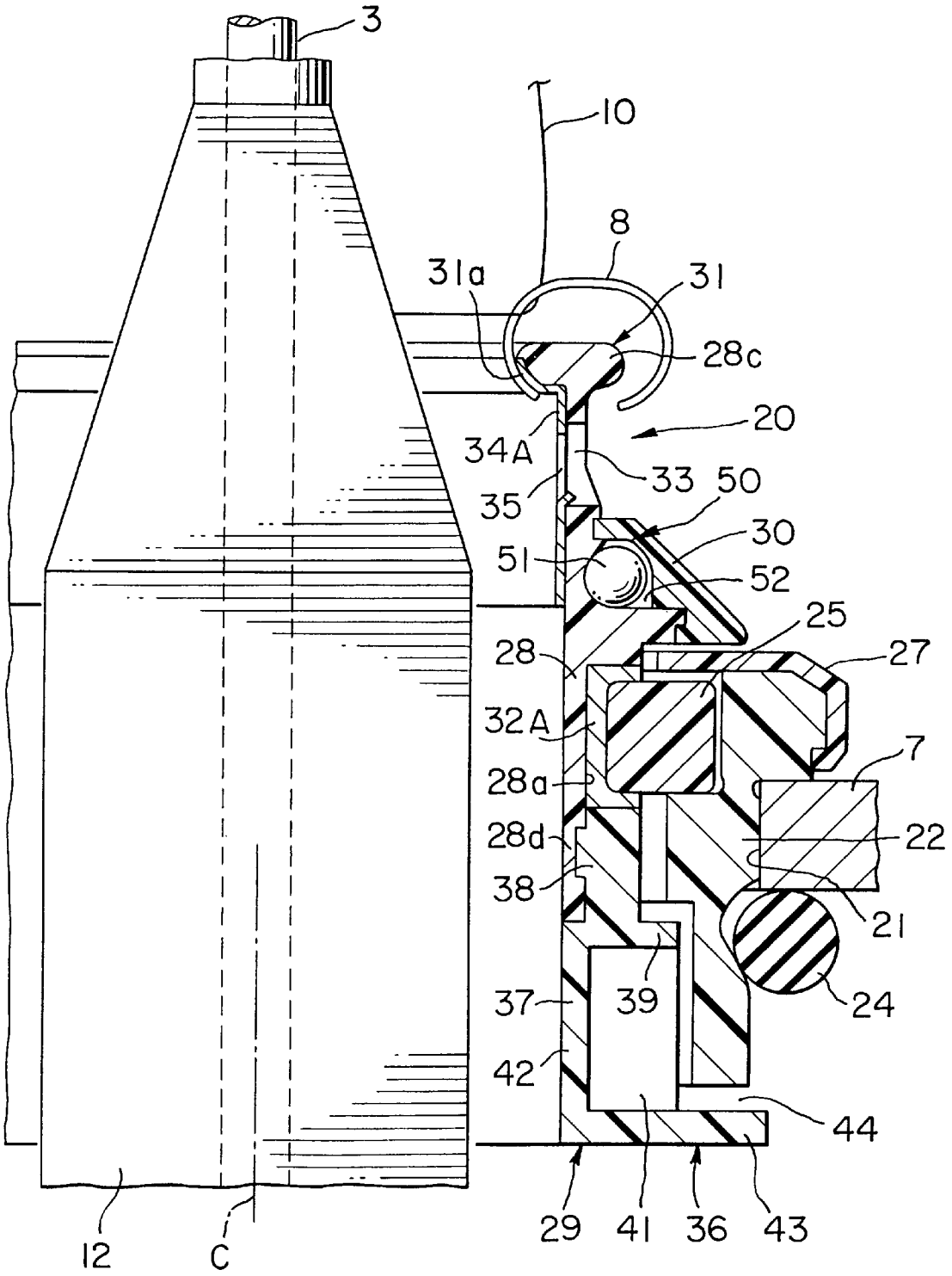
FIG. 5 is a half section of a rotary spinning ring structure in a second embodiment according to the present invention.

Referring to FIG. 5 showing a rotary spinning ring structure 20 according to a second embodiment of the present invention, the upper end of a rotating tubular body 28 is bulged radially inward and outward to form inner and outer flanges 28*c*. A plurality of fly outlet openings 33 are formed in a portion of the rotating tubular body 28 below the flanges 28*c*. A thin-wall traveler guide ring 34A is fitted in an upper end portion of the rotating tubular body 28 from below. The traveler guide ring 34A is formed of a steel having a hardness higher than the material of the rotating tubular body 28 and high abrasion resistance, and is provided with fly outlet openings 35 respectively correspond to the fly outlet openings 33. A lower edge portion of each fly outlet openings 35 is deformed or folded over a corresponding lower edge of the fly outlet openings 33 of the rotating tubular body 28 to secure the traveler guide ring 34A to the rotating tubular body 28. The rotating tubular body 28 is provided in its outer circumference with a recessed cylindrical surface 28*a*. An annular reinforcing bearing 32A formed by pressing of a steel having a hardness higher than that of the material forming the rotating tubular body 28 and excellent abrasion resistance is fitted fixedly on the cylindrical surface 28*a*.

The traveler guide ring 34 shown in FIG. 2 may be employed instead of the traveler guide ring 34A of FIG. 5, and the reinforcing bearing 32 of FIG. 2 may be employed instead of the reinforcing bearing 32A of FIG. 5.

The rotary spinning ring structure in the second embodiment is substantially the same as the rotary spinning ring structure in the first embodiment shown in FIG. 2 and hence further description thereof will be omitted.

Third Embodiment

Figure 6:
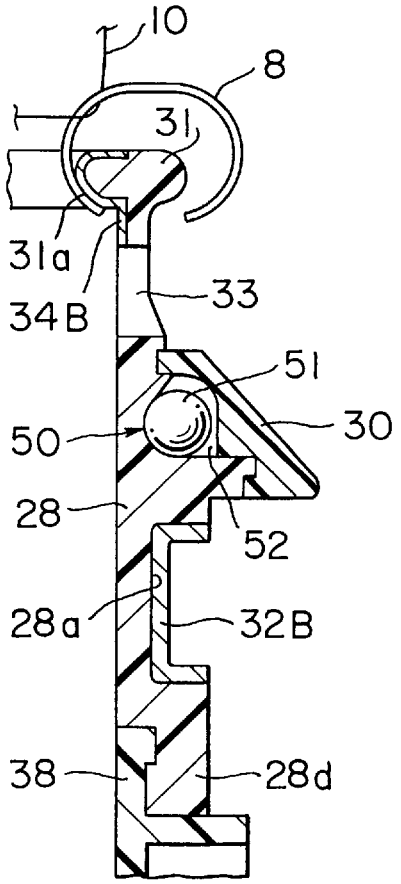
FIG. 6 is a half vertical section of a rotary spinning ring structure in a third embodiment according to the present invention.

FIG. 6 is a half-sectional view of a rotating tubular body 28 included in a rotary spinning ring structure in a third embodiment according to the present invention. The rotating tubular body 28 is formed of a synthetic resin. A traveler guide ring 34B and a reinforcing bearing member 32B are incorporated into the rotating tubular body 28 by insert molding to omit processes for attaching the traveler guide ring 34B and the reinforcing bearing member 32B to the rotating tubular body 28. A traveler guide ring of a shape different from that of the traveler guide ring 34A shown in FIG. 5 may be employed.

The rotary spinning ring structure in the third embodiment is substantially the same as the rotary spinning ring structure in the first embodiment shown in FIG. 2 and hence further description thereof will be omitted.

Fourth Embodiment

Figure 7:
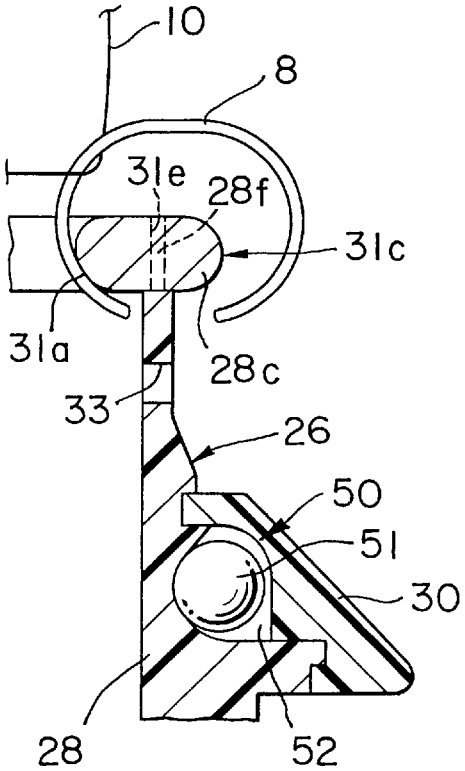
FIG. 7 is a half vertical section of a rotary spinning ring structure in a fourth embodiment according to the present invention.

FIG. 7 is a fragmentary half-sectional view of a rotating tubular body 28 included in a rotary spinning ring structure in a fourth embodiment according to the present invention. The rotating tubular body 28 is formed of a synthetic resin and a ring made of a steel or a ceramic material is attached to the upper end of the rotating tubular body 28 to provide the rotating tubular body 28 with a flange 31C having a traveler guide surface 31*a*. Although a rotating tube assembly 26 including the rotating tubular body 28 shown in FIG. 7 is heavier than those shown in FIGS. 2 and 5, the same is far lighter than conventional rotating tube assemblies. The flange 31C is highly resistant to heat and abrasion. The flange 31C is fastened to the rotating tubular body 28 by fitting pins 28*f* formed integrally with the rotating tubular body 28 in holes formed in the flange 31C.

The rotary spinning ring structure in the fourth embodiment is substantially the same as the rotary spinning ring structure in the first embodiment shown in FIG. 2 and hence further description thereof will be omitted.

Fifth Embodiment

Figure 8:
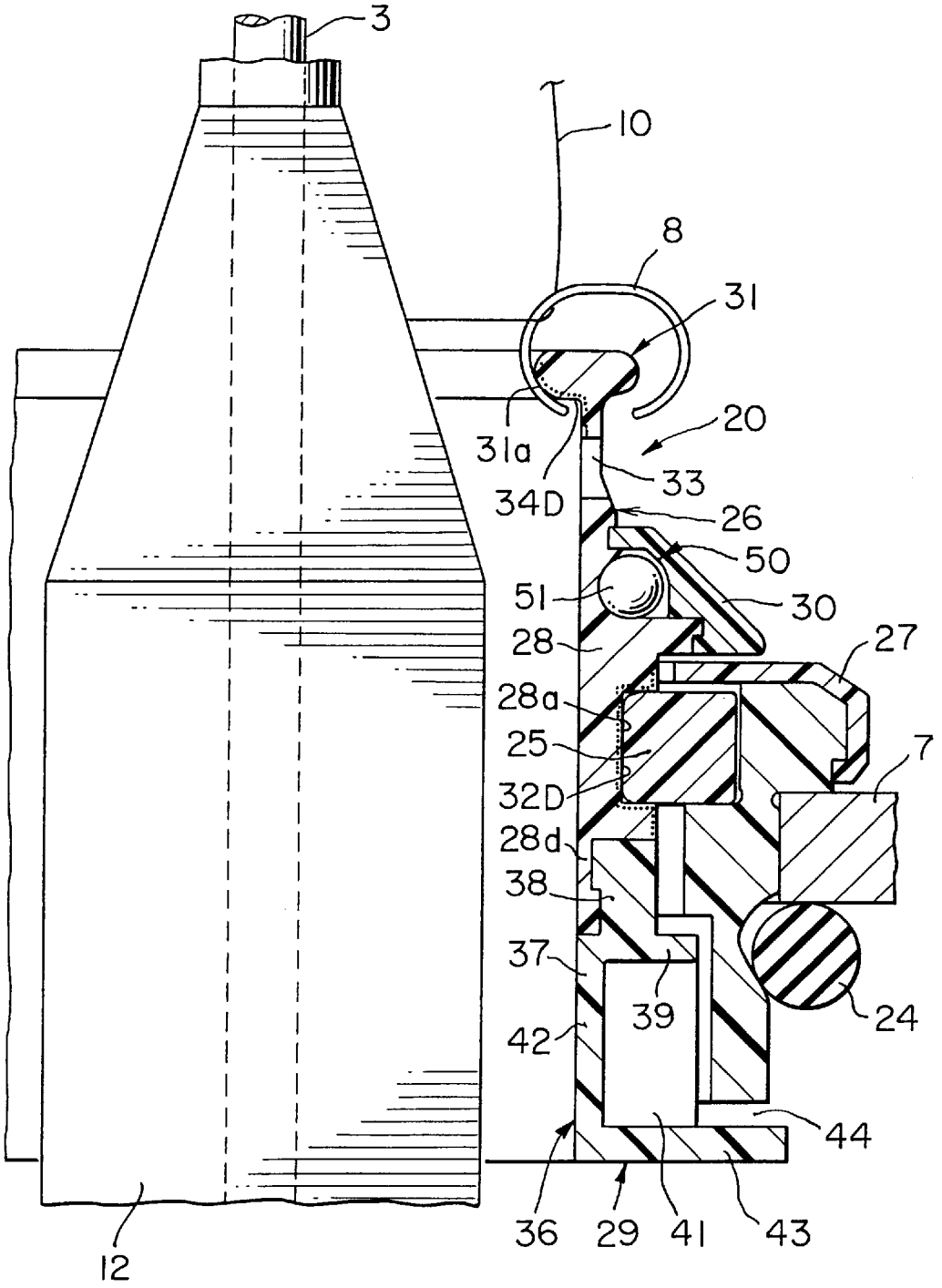
FIG. 8 is a half vertical section of a rotary spinning ring structure in a fifth embodiment according to the present invention.

FIG. 8 shows a rotary spinning ring structure 20 in a fifth embodiment according to the present invention. A synthetic resin rotating tubular body 28 has an annular flange 31D at its upper end and is provided in its outer circumference with a recessed cylindrical surface 28*a* for receiving a slide ring 25. The traveler guide surface 31*a* of the flange 31D and the working surface of the circular groove 28*a* are applied with metal films 34D and 32D having a hardness higher than that of the rotating tubular body 28 and high abrasion resistance, respectively. A rotating tube assembly 26 including the rotating tubular body 28 shown in FIG. 8 is lighter than the rotating tube assembly 26 including the rotating tubular body 28 provided with the traveler guide ring 34 (FIG. 2), 34A (FIG. 5) or 34B (FIG. 6), and a traveler guide surface 31*a* can be formed at a low cost.

The rotary spinning ring structure in the fifth embodiment is substantially the same as the rotary spinning ring structure in the first embodiment shown in FIG. 2 and hence further description thereof will be omitted.

Sixth Embodiment

Figure 9:
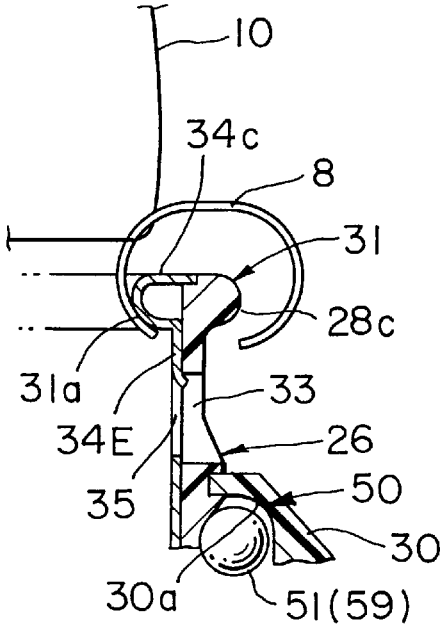
FIG. 9 is a fragmentary half section of a rotary spinning ring structure in a sixth embodiment according to the present invention.

FIG. 9 is a fragmentary half sectional view of a rotating tubular body 28 included in a rotary spinning ring structure in a sixth embodiment according to the present invention. The rotating tubular body 28 is formed of a light alloy having a specific gravity of five or below or a synthetic resin, and is provided with an outer flange 38*c* at its upper end. A traveler guide ring 34E formed by pressing a steel sheet or a stainless steel sheet is fitted in the rotating tubular body 28 from above. The traveler guide ring 34E is provided with an inner flange 34*c* at its upper end, and fly outlet openings 35 at positions respectively corresponding to fly outlet openings 33 formed in the rotating tubular body 28 in its cylindrical portion. An upper edge portion of each fly outlet opening 35 is deformed or folded over an upper edge portion of the fly outlet opening 33 to hold the traveler guide ring 34E fixedly on the rotating tubular body 28. The hollow inner flange of the traveler guide ring 34E is effective in efficiently dissipating heat generated in the traveler guide ring 34E.

The rotary spinning ring structure in the sixth embodiment is substantially the same as the rotary spinning ring structure in the first embodiment shown in FIG. 2 and hence further description thereof will be omitted.

Modifications

Figure 10:
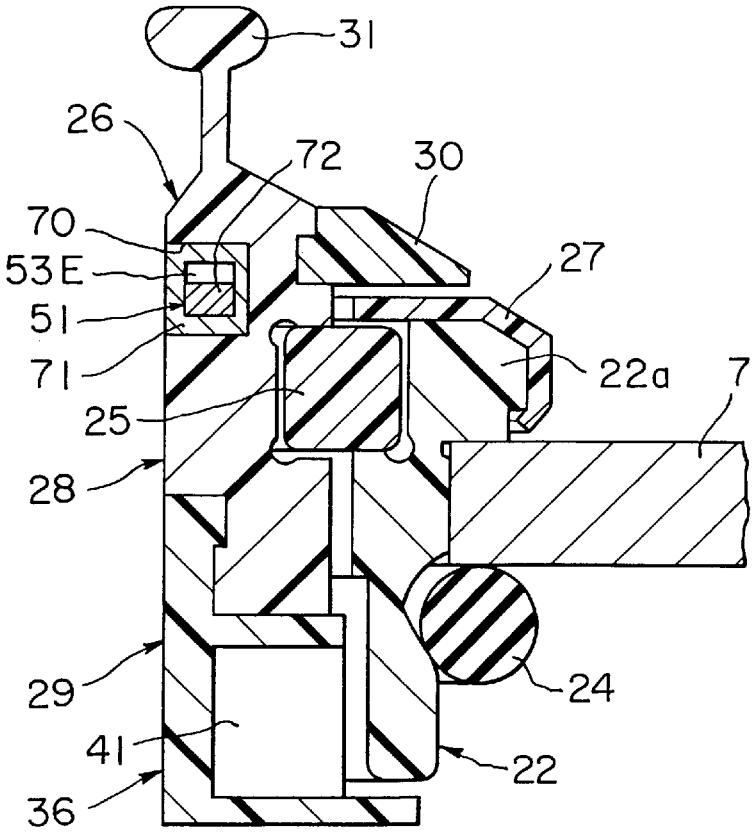
FIG. 10 is a vertical sectional view of a rotary spinning ring structure in a seventh embodiment according to the present invention.

FIG. 10 shows a balancing mechanism in a first modification of the balancing mechanism 50 shown in FIG. 2. As shown in FIG. 10, a circular groove 70 is formed in the inner circumference of a rotating tubular body 28 included in a rotating tube assembly 26, and a substantially toroidal member 71 made of a resin and having a sealed toroidal space 53E containing a balance fluid 72 is fitted in the circular groove 70. The balance fluid 72, which serves as a balance weight 51, is contained in the sealed toroidal space 53E in a depth corresponding to about half the height of the sealed toroidal space 53E. The balance fluid 72 may be any suitable liquid, such as water, salt water or an oil, a powder or particles. The toroidal member 71 may be placed in a flange 31 or a dust cover 30 included in the rotating tube assembly 26. The rotating tube assembly 26 may be provided with a plurality of toroidal members similar to the toroidal member 71. At least one spherical balance ball and a balance fluid, such as water, an oil or a powder, may be contained in the sealed toroidal space 53E to impede the movement of the balance ball by the fluid to avoid the excessively sensitive response of the balance ball.

When the rotating tube assembly 26 rotates, the balance fluid 72 flows to a side opposite the side of a mass eccentricity in the rotating tube assembly 26 to counterbalance the dynamic unbalance of the rotating tube assembly 26 by centrifugal force acting on the balance fluid 72. The balance fluid 72 flows smoothly and silently for a balancing action.

Figure 11:
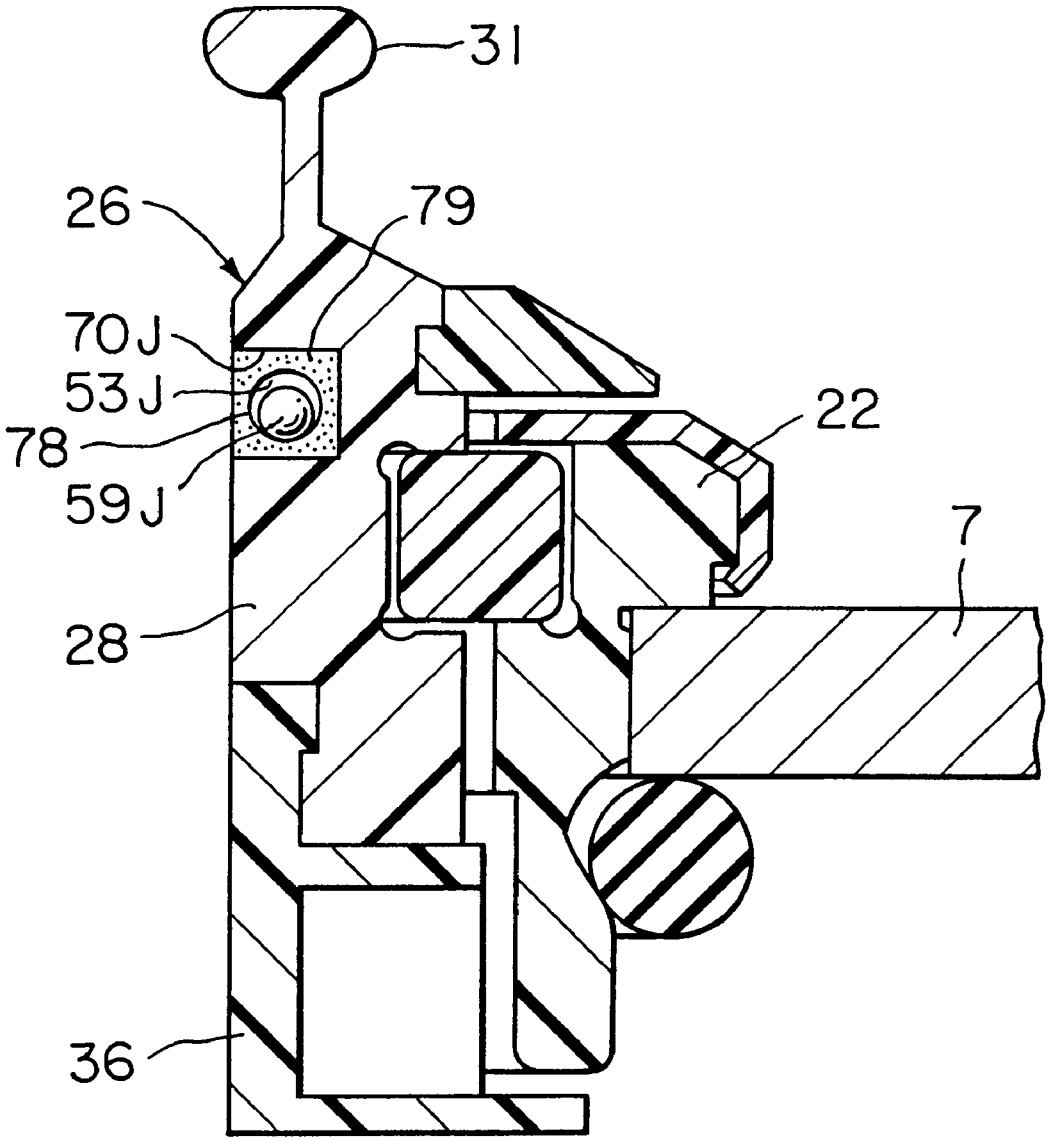
FIG. 11 is a vertical sectional view of a balancing mechanism in a first modification of a balancing mechanism included in the rotary spinning ring structure of FIG. 10.

FIG. 11 shows a balancing mechanism in a second modification of the balancing mechanism 50 shown in FIG. 2. As shown in FIG. 11, a circular groove 70J is formed in the inner circumference of a rotating tubular body 28 included in a rotating tube assembly 26, and a toroidal guide tube 78 of a circular cross section having a sealed toroidal space 53J containing a balance ball 59J is buried in a filler 79 filling up the circular groove 70J. The respective diameters of the section of the toroidal space 53J and the balance ball 59J are determined properly so as to form only a narrow space between the balance ball 59J and the inner circumference of the toroidal guide tube 78 to avoid the excessively sensitive response of the balance ball 59J.

When the rotating tube assembly 26 rotates, the balance ball 59J rolls gradually to a side opposite the side of a mass eccentricity in the rotating tube assembly 26 to counterbalance the dynamic unbalance of the rotating tube assembly 26 efficiently by a centrifugal force acting on the balance ball 59J.

Figure 12:
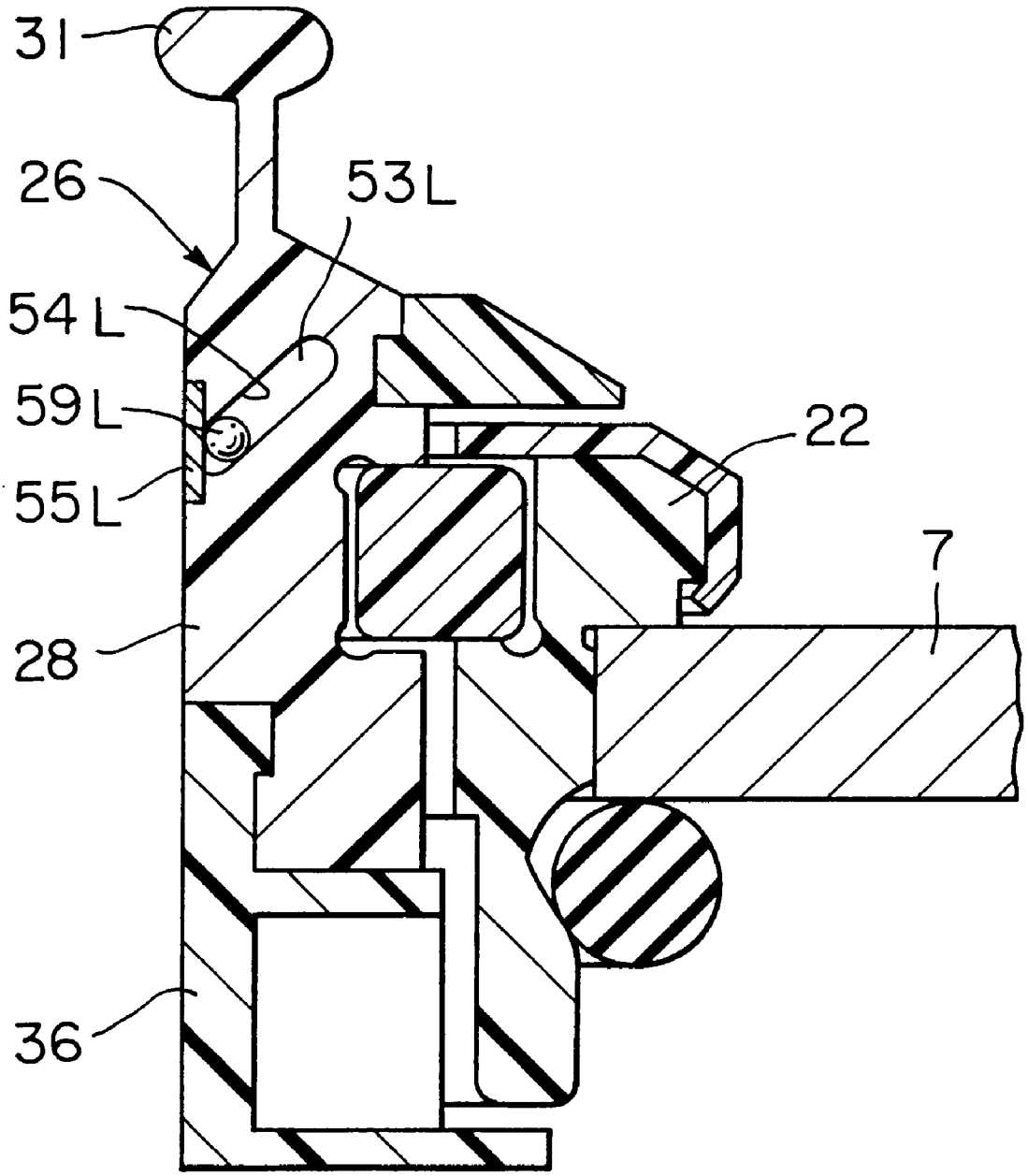
FIG. 12 is a vertical sectional view of a balancing mechanism in a second modification of a balancing mechanism included in the rotary spinning ring structure of FIG. 10.

FIG. 12 shows a balancing mechanism in a third modification of the balancing mechanism 50 shown in FIG. 2. As shown in FIG. 12, a guide groove 54L is formed in the inner circumference of a rotating tubular body 28 included in a rotating tube assembly 26. The guide groove 54L is inclined downward. The open end of the guide groove 54L opening inside the rotating tubular body 28 is closed with a closing ring 55L to define an inclined guide space 53L. At least one balance ball 59L is placed for rolling in the inclined guide space 53L. The balance ball 59L remains at the bottom of the inclined guide space 53L while the rotational speed of the rotating tube assembly 26 is not higher than a predetermined rotating speed.

The balance ball 59L is restrained from circumferential movement by a frictional resistance exerted thereon by the wall of the inclined guide space 53L and the outer circumference of the closing ring 55L or by a holding member, not shown, until the rotational speed of the rotating tube assembly 26 increases beyond a rotational speed corresponding to the resonance point. After the rotational speed of the rotating tube assembly 26 has exceeded the rotational speed corresponding to the resonance point, the balance ball 59L is moved obliquely upward along the inclined lower surface of the guide groove 54L to a side opposite the side of a mass eccentricity by centrifugal force to counterbalance the dynamic unbalance of the rotating tube assembly 26.

Figure 13:
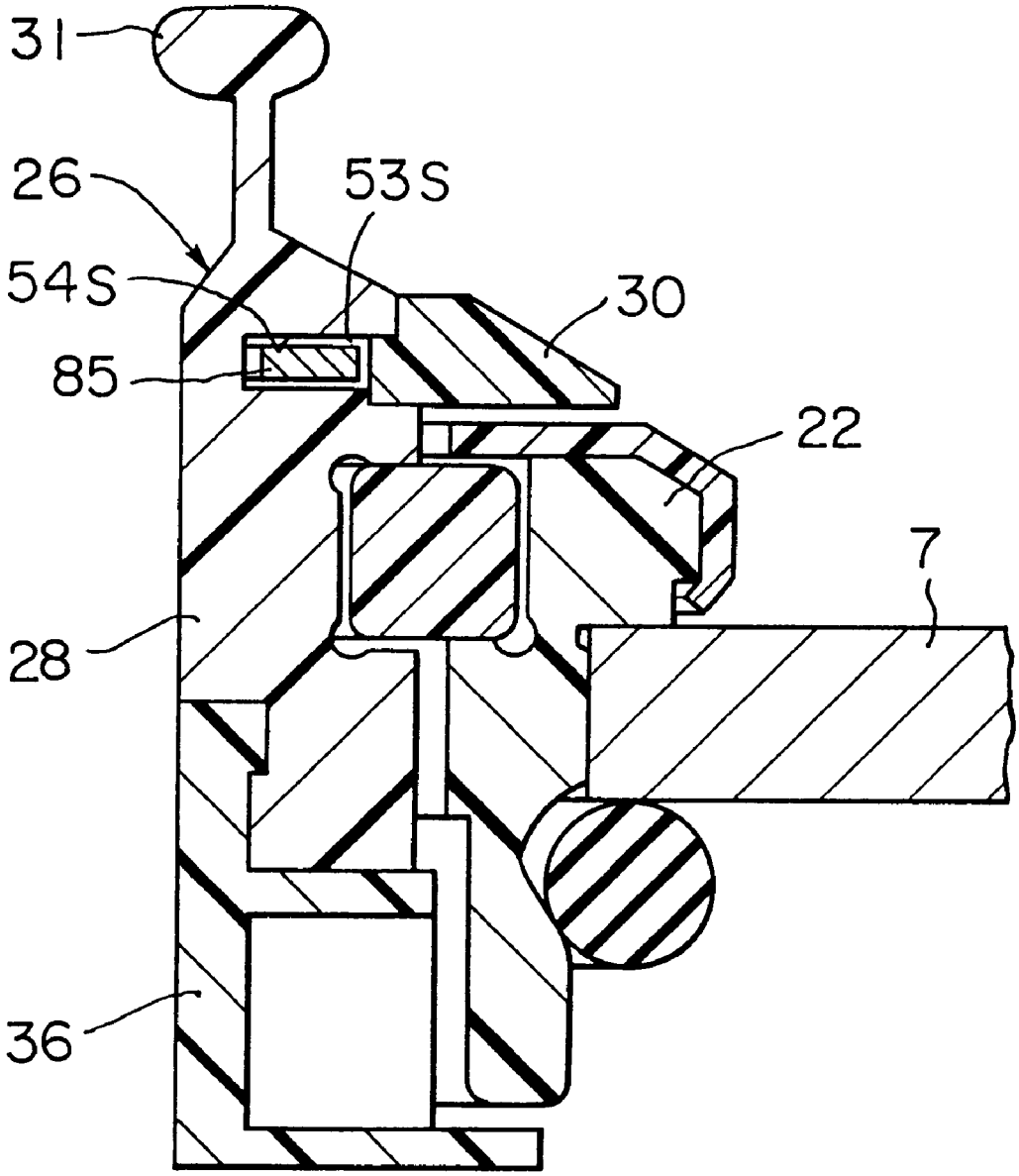
FIG. 13 is a vertical sectional view of a balancing mechanism in a third modification of a balancing mechanism included in the rotary spinning ring structure of FIG. 10.

FIG. 13 shows a balancing mechanism in a fourth modification of the balancing mechanism 50 shown in FIG. 2. As shown in FIG. 13, a rotating tubular body 28 included in a rotating tube assembly 26 is provided in its outer circumference with a circular guide groove 54S having an axis aligned with the axis of the rotating tube assembly 26. The outer open end of the guide groove 54S is closed with a dust cover 30 fixed to the rotating tubular body 28 to form a circular guide space 53S. A balance ring 85 is placed in the guide space 53S so as to be movable in circumferential directions and radial directions. The balance ring 85 is moved by centrifugal force acting thereon so that its inner circumference comes into contact with the inner side wall of the guide space 53S.

When the rotating tube assembly 26 rotates, the balance ring 85 moves to a side opposite the side of a mass eccentricity in the rotating tube assembly 26 to counterbalance the dynamic unbalance of the rotating tube assembly 26 by centrifugal force acting thereon. This balancing mechanism dose not need any special closing ring for closing the guide groove 54S to define the guide space 53S.

As is apparent from the foregoing description, according to the present invention, the rotating tube assembly is light in weight and has a relatively small moment of inertia because the principal part of the rotating tube assembly is formed of a light alloy having a specific gravity of five or below or a synthetic resin material. Therefore, the quality of the yarn can be improved because the yarn can be wound on the bobbin at an appropriate tension, a yarn piecing operation can be surely achieved even if the spinning frame is operating at a high spindle speed, power necessary for driving the spindles can be reduced and hence the cost of the yarn can be reduced. The friction between the traveler and the traveler guide surface can be reduced, the life of the traveler can be extended, maintenance cost and parts cost necessary for changing abraded travelers can be saved, and the useful life of the bearing member is extended because load on the bearing member is reduced. Although the rotating tube assembly is formed in a lightweight structure, the traveler guide ring or the traveler guide surface for guiding the traveler is formed of a metal or ceramic material having high abrasion resistance and a hardness higher than that forming the rotating tubular body. Therefore, the traveler guide ring or the traveler guide surface is highly durable, and will not be damaged by heat which may be generated if a trouble occurs around the traveler guide ring or the traveler guide surface. Thus, the rotary spinning ring structure of the present invention can be effectively used on advanced high-speed spinning frames.

Although the principal part of the rotating tube assembly is formed of a synthetic resin material to construct the rotating tube assembly in a lightweight structure, the accumulation of static electricity on the rotating tube assembly can be prevented. Accordingly, the harmful effects of static electricity, such as attraction of flies and dust to and accumulation of the same on the rotating tube assembly, twisting flies and such fell off the rotating tube assembly into the yarn, the discharges of static electricity accumulated on the rotating tube assembly at a high voltage giving the operator an electric shock, and generation of sparks and arcs causing waste fibers to burn, can surely be eliminated. Thus, the rotary spinning ring structure of the present invention is advantageous in respect of safety.

Since the balancing mechanism for keeping the rotating tubular body in a dynamically balanced state is incorporated into the rotating tube assembly, the dynamic unbalance of the rotating tube assembly attributable to a mass eccentricity in the rotating tub assembly or to the action of the traveler can be counterbalanced. Consequently, the rotating tube assembly is able to rotate smoothly, travelers of a weight in a wide weight range can be used in combination with the rotary spinning ring structure of the present invention, the rotary spinning ring structure of the present invention can be used for spinning yarns of a yarn count in a wide yarn count range. The rotating tube assembly is prevented from whirling and resultant generation of vibrations, so that the tension of yarns in the spinning process is stabilized, yarns of satisfactory yarn quality can be produced, the productivity of the spinning frame is improved because the yarn winding speed can be increased, and the rotary spinning ring structure can be used for an extended period of operation because the variation of the resistance and the level of the resistance of the bearing members can be reduced.

Since the rotating tubular body is provided with a circular guide groove and the balance weight is placed in the guide groove for movement therein, the balance weight is able to move easily along the guide groove to a side opposite the side of a mass eccentricity with respect to the center axis of rotation of the rotating tube assembly to counterbalance the dynamic unbalance of the rotating tube assembly efficiently.

Although the invention has been described in its preferred forms with a certain degree of particularity, obviously many changes and variations are possible therein. It is therefore to be understood that the present invention may be practiced otherwise than as specifically described herein without departing from the scope and spirit thereof.

What is claimed is:

1. A rotary spinning ring structure comprising a stationary tube fixedly supported on a ring rail of a spinning frame coaxially with a spindle supported on a spindle rail; and a rotating tube assembly supported for rotation on the stationary tube and including a rotating tubular body having a traveler guide portion to guide a traveler, wherein at least a major portion of the rotating tube's body, not including the traveler guide portion is formed of a first material having a specific gravity of five or below, and the traveler guide portion of the rotating tubular body is formed of a second material having an abrasion resistance and a hardness higher than that of the rotating tubular body.

2. The rotary spinning ring structure according to claim 1, wherein said first material is a synthetic resin.

3. The rotary spinning ring structure according to claim 1, wherein said first material is a light alloy.

4. The rotary spinning ring structure according to claim 1, wherein said second material is a metal.

5. The rotary spinning ring structure according to claim 1, wherein said second material is a ceramic material.

6. The rotary spinning ring structure according to claim 1, wherein said rotating tube assembly is supported for rotation by a slide ring on the stationary tube, and a bearing member to be brought into sliding contact with the slide ring is provided, said bearing member being formed of said second mateial.

7. The rotary spinning ring structure according to claim 1, wherein the traveler guide portion is formed on a traveler guide ring formed of said second material and fixedly fitted on an upper portion of the rotating tubular body.

8. The rotary spinning ring structure according to claim 7, wherein the traveler guide portion is a metal film formed on said traveler guide ring.

9. The rotary spinning ring structure according to claim 7, wherein the traveler guide portion is formed of a metal.

10. The rotary spinning ring structure according to claim 1, wherein at least a major portion of the rotating tubular body between the traveler guide portion and a bearing portion of the tubular body to be supported by said stationary tube is formed of an antistatic synthetic resin material, whereby static electricity generated in the traveler guide portion is discharged through the bearing portion to the ring rail.

11. The rotary spinning ring structure according to claim 1, wherein the rotating tube assembly is supported by a slide ring on the stationary tube, the stationary tube and the slide ring are formed of an antistatic synthetic resin material, at least said major portion of the rotating tubular body between the traveler guide portion and a bearing portion of the tubular body supported by said stationary tube is formed of an antistatic synthetic resin material, whereby static electricity generated in the traveler guide portion is discharged through the bearing portion, and the stationary tube to the ring rail.

12. The rotary spinning ring structure according to claim 11, wherein the antistatic synthetic resin material is a mixture of a synthetic resin, and a conductive material, and has a volume resistivity of $10^{12}$ Ω·cm or below.

13. The rotary spinning ring structure according to claim 1, wherein at least the major portion of the rotating tubular body between the traveler guide portion and a bearing portion of the tubular body supported by said stationary tube is formed of a synthectic resin material, said major portion having a surface coated with an antistatic synthetic resin material, whereby static electricity generated in the traveler guide portion is discharged through the bearing portion.

14. The rotary spinning ring structure according to claim 1 further comprising a balancing mechanism incorporated into the rotating tube assembly and including a balancing means which moves when the rotating tube assembly rotates to counterbalance the dynamic unbalance of the rotating tube assembly.

15. The rotary spinning ring structure according to claim 1, wherein a circular guide passage is formed coaxially with the rotating tubular body of the rotating tube assembly in the rotating tubular body, and a balancing means is placed for movement in the guide passage.

16. The rotary spinning ring structure according to claim 15, wherein the guide passage is a toroidal space, and the balancing means is weights.

17. The rotary spinning ring structure according to claim 15, wherein the guide passage is a sealed toroidal space, and the balancing means, is a balance fluid.

* * * * *